US008033130B2

(12) United States Patent
Cho et al.

(10) Patent No.: US 8,033,130 B2
(45) Date of Patent: Oct. 11, 2011

(54) REFRIGERATOR

(75) Inventors: Nam Soo Cho, Seoul (KR); Youn Seok Lee, Seoul (KR); Kyeong Yun Kim, Seoul (KR); Su Nam Chae, Seoul (KR); Sang Oh Kim, Seoul (KR); Jang Seok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 637 days.

(21) Appl. No.: 12/170,690

(22) Filed: Jul. 10, 2008

(65) Prior Publication Data

US 2009/0056366 A1 Mar. 5, 2009

(30) Foreign Application Priority Data

Jul. 11, 2007 (KR) ..... 10-2007-0069744

(51) Int. Cl.
*F25D 21/06* (2006.01)

(52) U.S. Cl. ..... 62/275; 62/441; 62/443

(58) Field of Classification Search ..... 62/275, 62/441, 407, 419, 285, 443; 312/116, 117
See application file for complete search history.

(56) References Cited

U.S. PATENT DOCUMENTS

| | | | | |
|---|---|---|---|---|
| 2,943,455 | A | 7/1960 | Reverman, Jr. | |
| 3,050,956 | A | 8/1962 | Mann et al. | |
| 3,609,988 | A | 10/1971 | Bright | |
| 3,834,177 | A * | 9/1974 | Scarlett | 62/288 |
| 4,282,720 | A * | 8/1981 | Stottmann et al. | 62/180 |
| 4,682,474 | A * | 7/1987 | Janke | 62/187 |
| 4,922,728 | A * | 5/1990 | Backus | 62/278 |
| 4,924,680 | A * | 5/1990 | Janke et al. | 62/187 |
| 5,168,621 | A | 12/1992 | Kruck et al. | |
| 5,187,941 | A * | 2/1993 | Tershak et al. | 62/89 |
| 5,477,699 | A * | 12/1995 | Guess et al. | 62/187 |
| 5,490,395 | A * | 2/1996 | Williams et al. | 62/187 |
| 6,047,554 | A * | 4/2000 | Choi | 62/154 |
| 6,209,342 | B1 | 4/2001 | Banicevic et al. | |
| 6,837,067 | B2 * | 1/2005 | Lee | 62/441 |
| 7,152,419 | B1 * | 12/2006 | Armour et al. | 62/187 |
| 7,174,729 | B2 * | 2/2007 | Cushman et al. | 62/157 |
| 7,377,124 | B2 * | 5/2008 | Kim et al. | 62/408 |
| 7,584,627 | B2 * | 9/2009 | Sim et al. | 62/407 |

FOREIGN PATENT DOCUMENTS

| | | |
|---|---|---|
| JP | 4-73573 | 3/1992 |
| JP | 11-248328 | 9/1999 |

* cited by examiner

*Primary Examiner* — Mohammad Ali

(74) *Attorney, Agent, or Firm* — Birch, Stewart, Kolasch & Birch, LLP

(57) ABSTRACT

A refrigerator having a body defined with a plurality of cooling compartments, a plate arranged to partition the cooling compartments, and a cold air supplier arranged at one wall of the plate, to supply a cold air to at least one of the cooling compartments.

16 Claims, 8 Drawing Sheets

REFRIGERATOR

CROSS REFERENCE TO RELATED APPLICATIONS

This application claims the benefit of Korean Patent Application No. 10-2007-0069744, filed on Jul. 11, 2007, which is hereby incorporated by reference as if fully set forth herein.

BACKGROUND OF THE INVENTION

1. Field of the Invention

The present invention relates to a refrigerator, and more particularly to a refrigerator having a specific cooling compartment structure capable of providing a cooling compartment having a widened space by increasing the capacity of the cooling compartment.

2. Discussion of the Related Art

Generally, refrigerators are used to store food or the like in a cooling compartment, defined to include a refrigerating compartment and a freezing compartment in a refrigerator body, by supplying, to the cooling compartment, a cold air generated by a refrigerating cycle system constituted by a compressor, a heat exchanger, etc.

The refrigerating cycle system used in such a refrigerator includes a compressor for compressing a refrigerant, a condenser and a radiating fan, which function to condense the refrigerant compressed in the compressor, an expansion device for expanding the condensed refrigerant, and an evaporator for absorbing heat from ambient air via the expanded refrigerant, thereby evaporating the expanded refrigerant, and thus forming a low-temperature atmosphere.

In a conventional refrigerator, the evaporator is arranged in a space partitioned from the cooling compartment at the rear side of the cooling compartment. A passage for a flow of cold air generated by the evaporator is defined in the space, to supply the cold air to the cooling compartment.

However, the conventional refrigerator has a problem in that there is a limitation in increasing the capacity of the cooling compartment, due to the space in which the evaporator is arranged, and the cold air flow passage is defined.

SUMMARY OF THE INVENTION

Accordingly, the present invention is directed to a refrigerator that substantially obviates one or more problems due to limitations and disadvantages of the related art.

An object of the present invention is to provide a refrigerator having a specific cooling compartment structure capable of maximally increasing the capacity of a cooling compartment.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator comprises: a body defined with a plurality of cooling compartments; a plate arranged to partition the cooling compartments; and a cold air supplier arranged at one wall of the plate, to supply a cold air at least one of the cooling compartments.

The refrigerator may further comprise a cold air generator arranged at a rear side of at least one of the cooling compartments, except for the cooling compartment cooled by the cold air supplier.

The cold air supplier may comprise a cooler for generating a cold air, a fan unit for blowing the cold air generated by the cooler, and a cavity provided at one wall of the plate, to provide a seat for mounting the cooler and a passage for guiding the cold air generated by the cooler.

The cavity may comprise a mounting section formed in the form of a recess, to provide the seat for the cooler, and a passage section communicating with the mounting section and defining a flow path for the cold air generated by the cooler.

At least one of wall and corner portions of the mounting and passage sections may be rounded.

The plate may include an embossing protruded from one wall or each wall of the plate, to increase a rigidity of the plate.

The cavity may further comprise a recess formed to a predetermined depth at a bottom of the mounting section, to prevent the cooler seated on the mounting section from coming into contact with a portion of the bottom of the mounting section or with an overall portion of the bottom of the mounting section.

The cavity may further comprise protrusions formed to a predetermined height at a bottom of the mounting section. The cooler may include hangers engaged with the protrusions, respectively, to support the cooler.

The refrigerator may further comprise a panel arranged to cover the cavity. The panel may include an outlet for allowing the cold air flowing through the passage section to be discharged to the cooling compartment associated with the cold air supplier, and an inlet for allowing the cold air to be sucked into the cavity after circulating the associated cooling compartment.

The panel may further include a receiving section for receiving the fan unit.

The cooler may comprise a cold air generator for generating a cold air, and a heater for defrosting the cold air generator.

The heater may comprise a cord heater including a cord partially or completely covering the cold air generator of the cooler.

Alternatively, the heater may comprise a plate heater including a plate partially or completely covering the cold air generator of the cooler.

The cavity may further comprise a drainage section arranged at a lower end of the mounting section, to guide condensed water generated at the cooler during a defrosting operation such that the condensed water is drained.

The drainage section may include an inclined portion having a predetermined downward inclination to allow condensed water generated at the cooler during a defrosting operation to flow easily, and a drainage hole arranged at a lower end of the inclined portion, to drain the condensed water flowing along the inclined portion.

The refrigerator may further comprise a drainage guiding member arranged at the drainage section, to guide the drainage of the condensed water generated at the cooler.

The drainage guiding member may include a guide having an upper end opened to allow the condensed water from the cooler to be introduced into the guide, and a lower end inclined by a predetermined angle such that the guide faces the inclined portion, and a drainage tube formed at the lower end of the guide, to communicate with the drainage hole.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
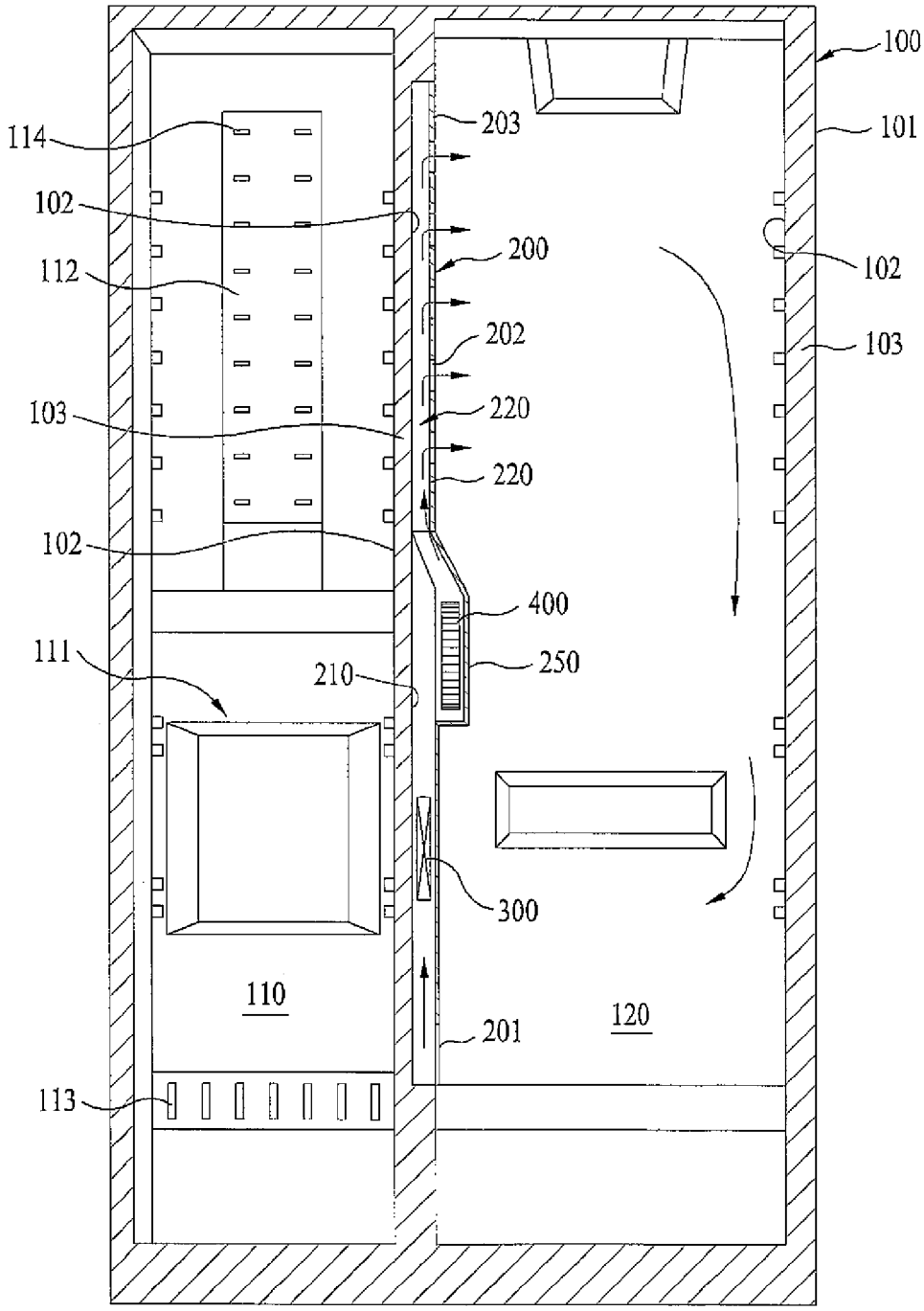
FIG. 1 is a front view of a refrigerator according to an exemplary embodiment of the present invention, illustrating the section of a cold air supplier.

Referring to FIG. 1, a refrigerator according to an exemplary embodiment of the present invention is illustrated. The refrigerator includes a body 100 defining the outer appearance of the refrigerator and defined with a plurality of cooling compartments, in particular, two cooling compartments 110 and 120 in the illustrated case, and a plate 200 for partitioning the cooling compartments 110 and 120.

Although FIG. 1 illustrates the case in which the interior of the body 110 is partitioned by the plate 200, to define two compartments, namely, first and second cooling compartments 110 and 120, the refrigerator according to the present invention is applicable not only to the case including a single cooling compartment, but also to the case including three or more cooling compartments.

Figure 2:
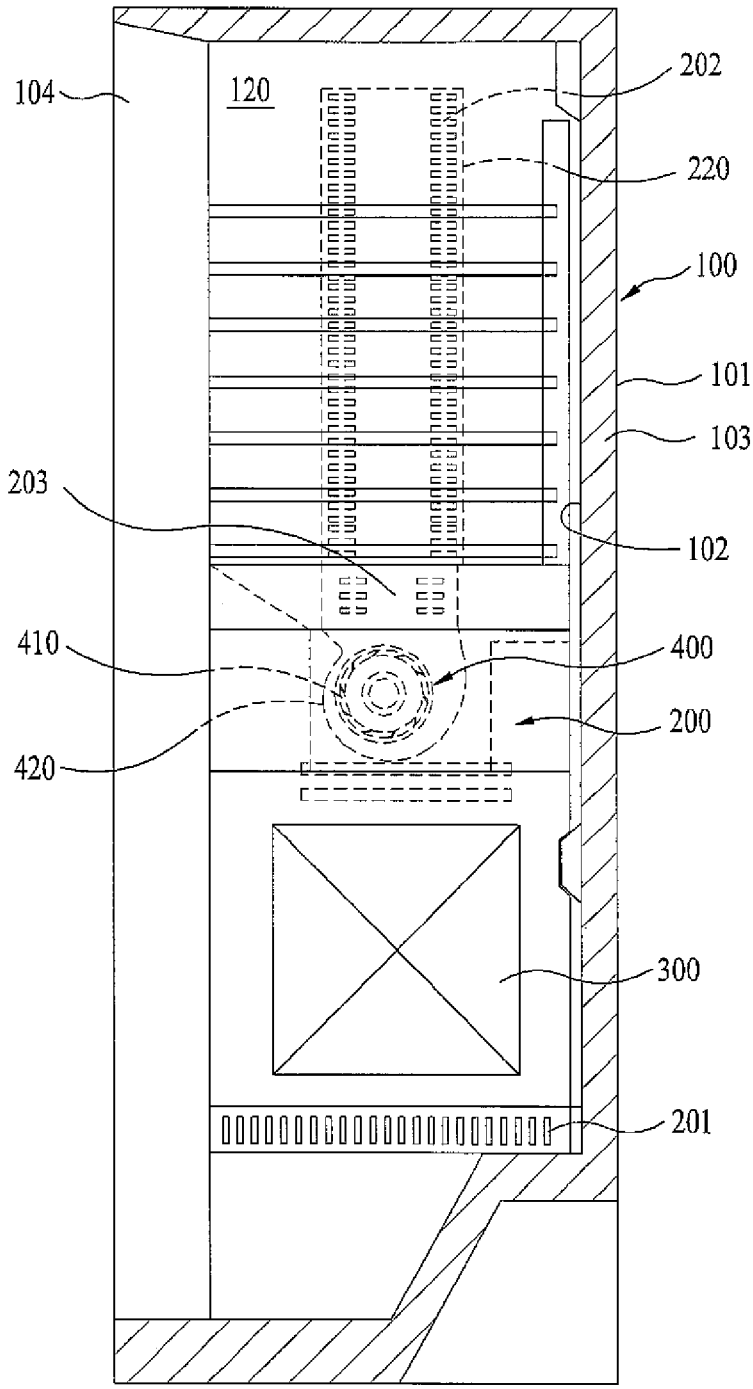
FIG. 2 is a sectional view of the refrigerator according to the illustrated embodiment of the present invention, illustrating the front side of the cold air supplier.

As shown in FIGS. 1 and 2, the body 100 includes an outer case 101, inner cases 102, and a foamed insulator filled between the outer case 101 and each inner case 102.

In the embodiment illustrated in FIG. 1, the plate 200 is formed integrally with the body 100. Where the plate 200 is formed integrally with the body 100, as shown in FIG. 1, it is constituted by facing portions of the inner cases 102, and a foamed insulator filled between the facing inner case portions.

On the other hand, where the plate 200 is manufactured separately from the body 100, and is assembled to the body 100, it is constituted by outer and inner cases, and a foamed insulator filled between the outer and inner cases.

Meanwhile, in the embodiment illustrated in FIG. 1, the first cooling compartment 110 is provided with a cold air generator arranged at the rear side of the first cooling compartment 110, so as to be cooled by the cold air generator. The second cooling compartment 120 is cooled by a cold air supplier provided at the plate 200.

That is, the cold air generator provided at the first cooling compartment 110 includes an evaporator 111 for generating a cold air, and a duct guiding the cold air generated by the evaporator 111 to flow. Although not shown, the cold air generator also includes a cooling fan, in order to blow the cold air generated by the evaporator 111 to the first cooling compartment 110.

A cold air inlet 113 is arranged beneath the evaporator 111, to allow the cold air circulating in the first cooling compartment 110 to be sucked through the cold air inlet 113 by the cooling fan (not shown). A cold air outlet 114 is provided at the duct 112, to supply the cold air blown by the cooling fan (not shown) to be supplied to the first cooling compartment 110.

In the refrigerator according to the embodiment of the present invention illustrated in FIGS. 1 and 2, the second cooling compartment 120 is cooled by the cold air supplier provided at the plate 200, as described above.

That is, the cold air supplier is arranged at the wall of the plate 200 facing the second cooling chamber 120. The cold air supplier includes a cooler 300 for generating a cold air, a fan unit 400 for blowing the cold air generated by the cooler 300, and a cavity provided at the wall of the plate 200 facing the second cooling compartment 120.

As shown in FIGS. 1 and 2, a panel 203 is provided at the plate 200, to cover the cavity.

Typically, the cooler 300 is implemented by a heat exchanger constituting a refrigerating cycle. However, the cooler 300 may comprise coolers using various cooling methods, for example, a thermoelectric device.

Figure 3:
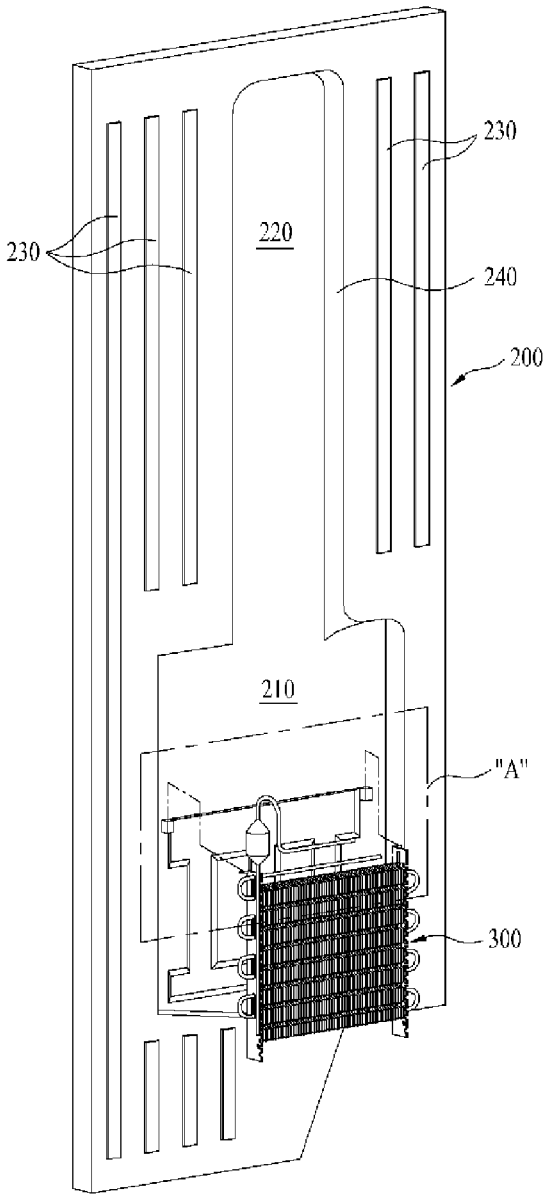
FIG. 3 is a view illustrating a plate included in the refrigerator according to the illustrated embodiment of the present invention, and a cold air supplier provided at the plate.

Referring to the sectional view of the plate 200 shown in FIG. 1 and the perspective view shown in FIG. 3, the structure of the cavity according to an exemplary embodiment of the present invention are shown.

As shown in FIGS. 1 and 3, the cavity includes a mounting section 210 formed in the form of a recess to provide a seat for the cooler 300, and a passage section 220 communicating with the mounting section 210 and providing a flow path for the cold air generated by the cooler 300.

A certain space is defined between a portion of the mounting section 210 where the cooler 300 is arranged and the passage section 220, as shown in FIGS. 1 and 3. In this space, the cold air to be sucked to the fan unit 400 stays temporarily.

That is, as shown in FIG. 1, the fan is installed such that it is protruded in the thickness direction of the plate 200 beyond the thickness of the plate 200. In accordance with this structure, the cold air generated at the mounting section 210 can be sucked by the fan unit 400, and can be blown to the passage section 220.

Accordingly, as shown in FIGS. 1 and 2, the fan unit 400 preferably includes a cross-flow fan 410. The cross-flow fan 410 axially sucks cold air, and radially blows the sucked cold air. Thus, the cross-flow 410 axially sucks cold air from the mounting section 210, and radially blows the sucked cold air.

The cross-flow fan 410 is arranged at the inside of the guide 420. Thus, the cold air radially blown by the cross-flow fan 410 is guided by the guide 420, to flow into the passage section 220.

As shown in FIGS. 1 and 2, the cross-flow fan 410 and guide 420 are received in a receiving section formed at the panel 203.

The panel 203 is also formed with an inlet 201 and an outlet 202. The inlet 201 is formed at a lower end of the panel 203, to allow the cold air circulating in the second cooling compartment 120 to re-flow into the cavity. The outlet 202 comprises a plurality of ports formed at the passage section 220 of the panel 203, to allow the cold air flowing through the passage section 220 to be supplied to the second cooling compartment 120.

The plate of the refrigerator will be described in more detail with reference to FIG. 3.

In accordance with the embodiment of the present invention illustrated in FIG. 3, the plate 200 includes facing portions of inner cases or facing portions of inner and outer cases, and a foamed insulator filled between the inner cases or between the inner and outer cases.

The presence of the mounting section 210 and passage section 220 in the cavity formed at one wall of the plate 200 causes the shape of the plate 200 to be complex at the wall of the plate 200. As a result, when a foaming liquid is injected into the cavity, in order to foam the insulator, it may be incompletely filled in the cavity.

To this end, in accordance with an embodiment of the present invention, the wall or corner portions of the cavity formed at one wall of the plate 200 are rounded, to allow the foaming liquid to flow smoothly in the interior of the plate 200, and thus to enable the filling of the insulator to be efficiently achieved.

That is, it is preferred that a round portion 240 be formed on at least one of the wall and corner portions of the mounting section 210 and passage section 220.

Meanwhile, the plate 200 has a reduced thickness at certain regions due to the formation of the cavity including the mounting section 210 and passage section 220. As a result, the plate 200 may have a reduced rigidity. To this end, it is preferred that embossings 230 be formed at one or both walls of the plate 200 in the form of protrusions.

Each embossing 230 may have various cross-sectional shapes. For example, each embossing 230 may have a semicircular or polygonal cross-sectional shape. In order to allow the foaming liquid to flow smoothly in the interior of the plate 200, it is preferred that the cross-section of each embossing 230 have a circular shape or a shape similar thereto.

Meanwhile, FIG. 3 illustrates a heat exchanger as the cooler 300 mounted in the mounting section 210. In this case, it is preferred that a defrosting heater be installed at the heat exchanger 300. Details of the cooler 300 will be described with reference to FIGS. 4 and 5.

Figure 4:
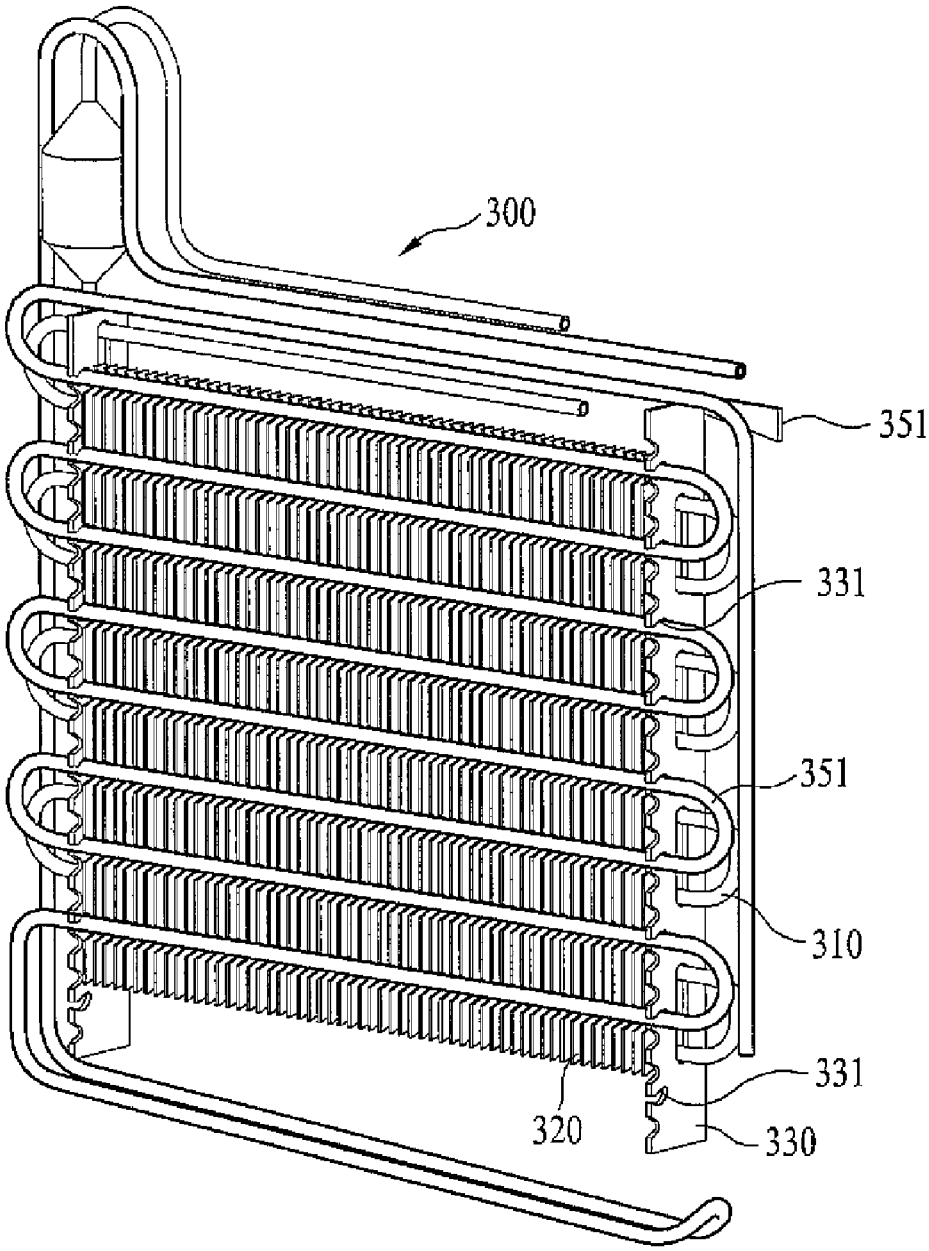
FIG. 4 is a view illustrating an example of a cooler mounted in the refrigerator according to the illustrated embodiment of the present invention.

As shown in FIG. 4, the heat exchanger 330, which is mounted to the plate in the refrigerator according to the illustrated embodiment of the present invention includes a cooling tube 310, cooling fins 320, and supporting members 330 for supporting the cooling tube 310 and cooling fins 320.

The cooling tube 310 has a meandering shape. A refrigerant flows through the cooling tube 310, to be evaporated while absorbing heat from ambient air. That is, the refrigerant performs heat exchange with the ambient air via the cooling tube 310. The cooling fins 320 function to increase the heat exchange area of the cooling tube 310.

The supporting members 330 are arranged at opposite sides of the heat exchanger 300, to support the cooling tube 310 and cooling fins 320.

As described above, the heater is installed to defrost the heat exchanger 300. In the case of FIG. 4, the heater comprises a cord heater 351 having the form of a cord.

The cord heater 351 has a shape similar to the cooling tube 310 and extends throughout the heat exchanger 300. Each supporting member 330 has supporting grooves 331 for firmly holding the cord heater 351.

The cord heater 351 is easily flexible, and can be efficiently installed throughout the heat exchanger 300. Accordingly, the cord heater 351 can efficiently perform a defrosting operation for the heat exchanger 300. Taking into consideration the fact that the usage space of the heat exchanger 300 is very narrow, the cord heater 351 can reduce the influence of heat applied to the plate 200 (FIG. 3), and thus can prevent the cavity or panel from being deformed.

Figure 5:
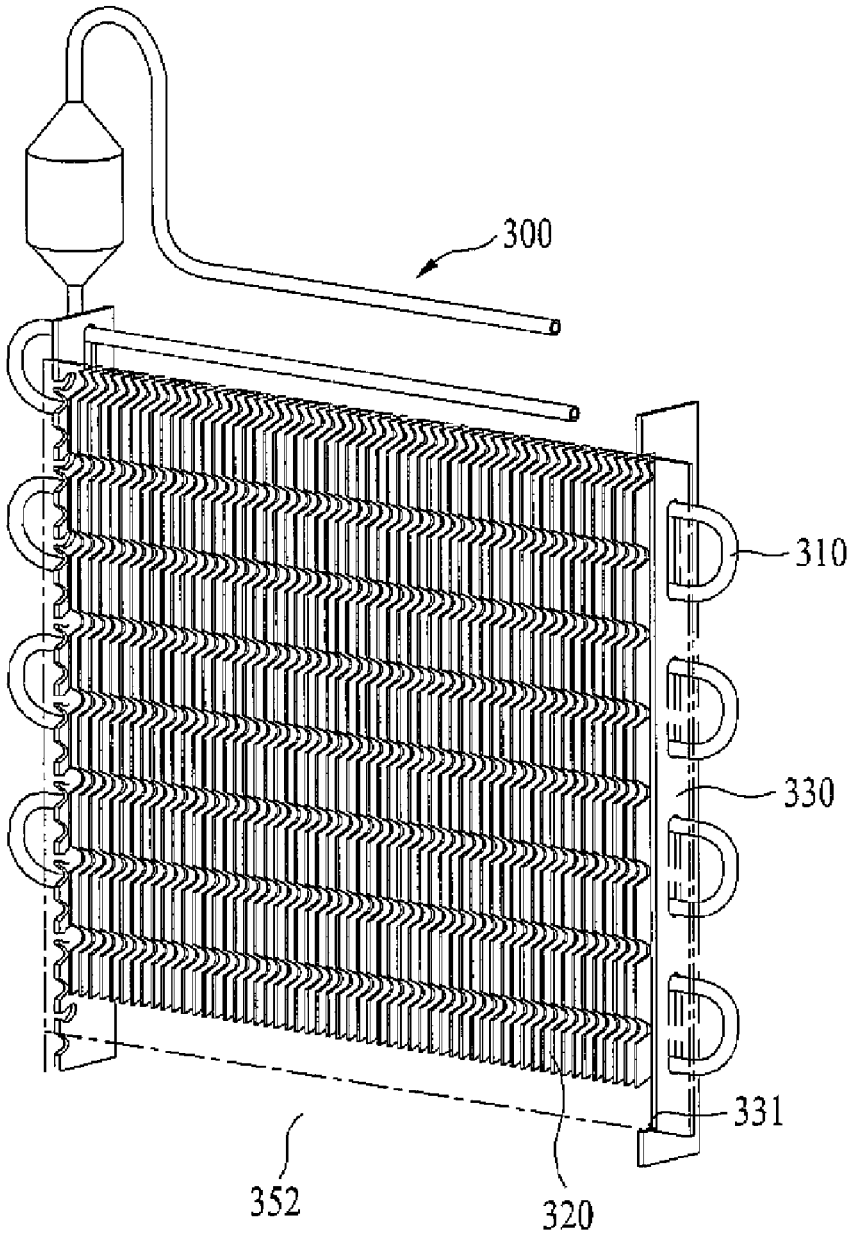
FIG. 5 is a view illustrating another example of the cooler mounted in the refrigerator according to the illustrated embodiment of the present invention.

Meanwhile, similarly to the embodiment of FIG. 4, in a refrigerator according to another embodiment of the present invention shown in FIG. 5, the heat exchanger 300 mounted to the plate of the refrigerator includes a cooling tube 310, cooling fins 320, and supporting members 330 for supporting the cooling tube 310 and cooling fins 320.

Since the cooling tube 310, cooling fins 320, and supporting members 330 are substantially identical to those of FIG. 4, no detailed description thereof will be given.

In the embodiment illustrated in FIG. 5, a plate heater 352 is used for the defrosting heater. The plate heater 352 partially or completely covers the heat exchanger 300.

Each supporting member 330 has supporting grooves 331 for firmly holding the plate heater 352.

Where the plate heater 352 is used as described above, it can efficiently perform a defrosting operation for the heat exchanger 300. Taking into consideration the fact that the usage space of the heat exchanger 300 is very narrow, the plate heater 352 can reduce the influence of heat applied to the plate 200 (FIG. 3), and thus can prevent the cavity or panel from being deformed.

As shown in FIG. 4 or 5, each supporting member 330 includes a hanger 340. Details of the hanger 340 will be described later.

A structure for mounting the cooler in the cavity will be described in more detail with reference to FIG. 6.

Figure 6:
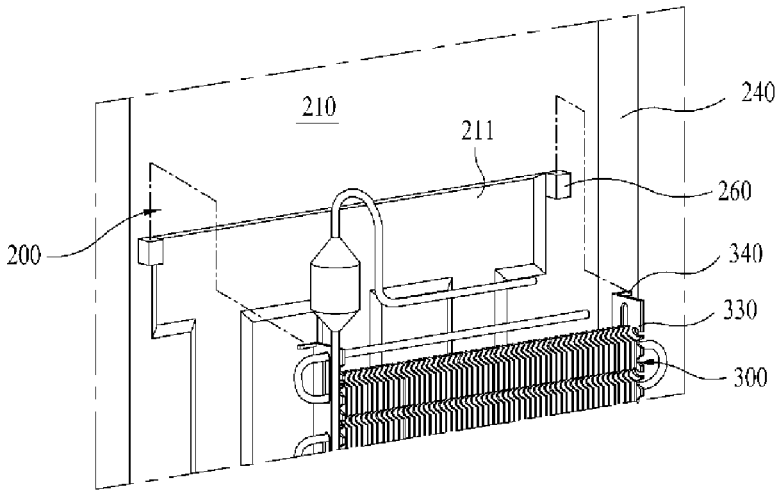
FIG. 6 is an enlarged view corresponding to a portion A of FIG. 3.

FIG. 6 is an enlarged view corresponding to a portion A of FIG. 3. As shown in FIG. 6, the mounting section 210, to which the cooler 300 is mounted, includes a recess 211 having a certain depth.

Protrusions 260 are arranged on an upper end of the recess 211 at opposite sides of the recess 211. The hangers 340 provided at the cooler 300 are engaged with the protrusions 260, respectively. Thus, the cooler 300 can be mounted to a region where the recess 211 of the mounting section 210 is formed.

When a groove or hole is formed at the mounting section 210, to insert a portion of the cooler 300 into the groove or hole, and thus to install the cooler 300, a degradation in thermal insulating performance may occur. To this end, in the refrigerator according to the illustrated embodiment of the present invention, the protrusions 260 are formed at the mounting section 210, and the cooler 300 is hung on the protrusions 260, to be firmly mounted, in order to avoid a reduction in thermal insulating performance.

The protrusions 260 may have any shape, as long as they can easily engage with the hangers 340, and can sufficiently support the cooler 300.

For example, although each protrusion 260 has a structure simply horizontally protruded by a certain length, in the case of FIG. 6, it may be formed to have a structure upwardly bent in the form of an "L" shape.

Each hanger 340 may comprise a separate member fixed to the cooler 300. Alternatively, each hanger 340 may be formed integrally with the associated supporting member 330 at an upper end of the supporting member 330, as shown in FIG. 6.

The formation of each hanger 340 using a separate member means that the hanger 340 is formed using various methods. For example, in order to form the hanger 340, a groove is formed at the associated supporting member 330, and a protrusion member is engaged with the groove.

Figure 7:
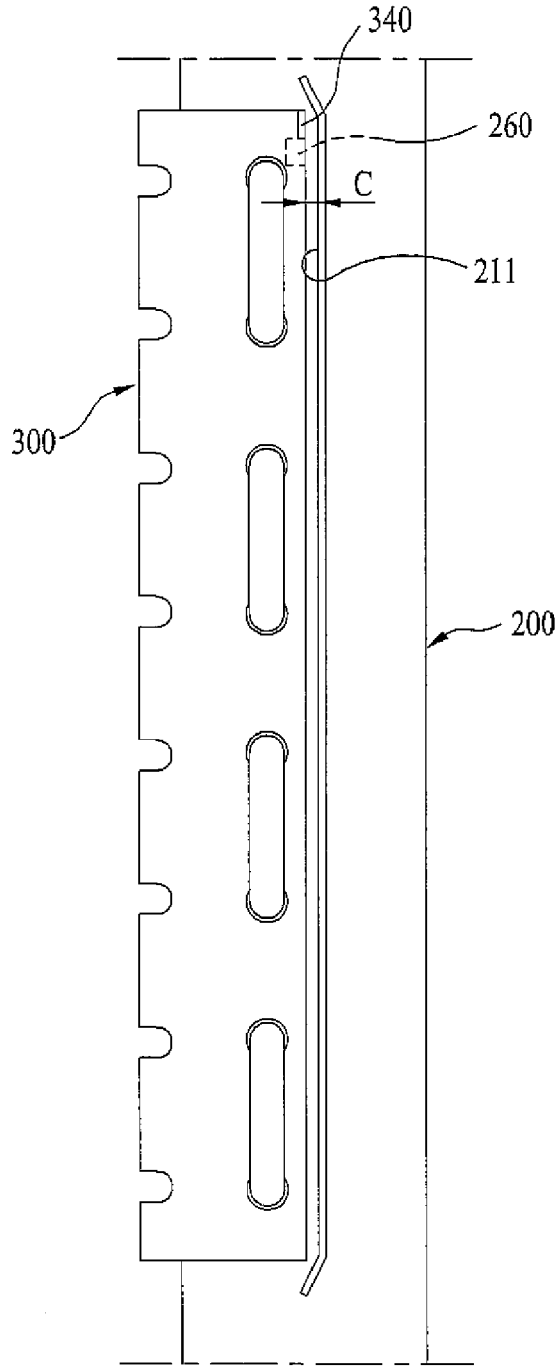
FIG. 7 is a side view illustrating a state in which the cooler is mounted to the plate of the refrigerator according to the illustrated embodiment of the present invention.

Meanwhile, the recess 211 has a predetermined depth such that a certain gap C is formed between the recess 211 and the cooler 300 when the cooler 300 is mounted to the protrusions 260, as shown in FIG. 7.

In accordance with the formation of the gap C, it is possible to prevent the plate 200 from being influenced by the cold air generated by the cooler 300, namely, from being deformed due to thermal stress.

That is, the cooler 300 is prevented from coming into direct contact with the mounting section 210, to prevent the inner case from being damaged due to thermal stress.

It is also preferred that there is a structure for efficiently draining condensed water generated when a defrosting operation for the cooler 300 is carried out. This drainage structure will be described with reference to FIG. 8.

Figure 8:
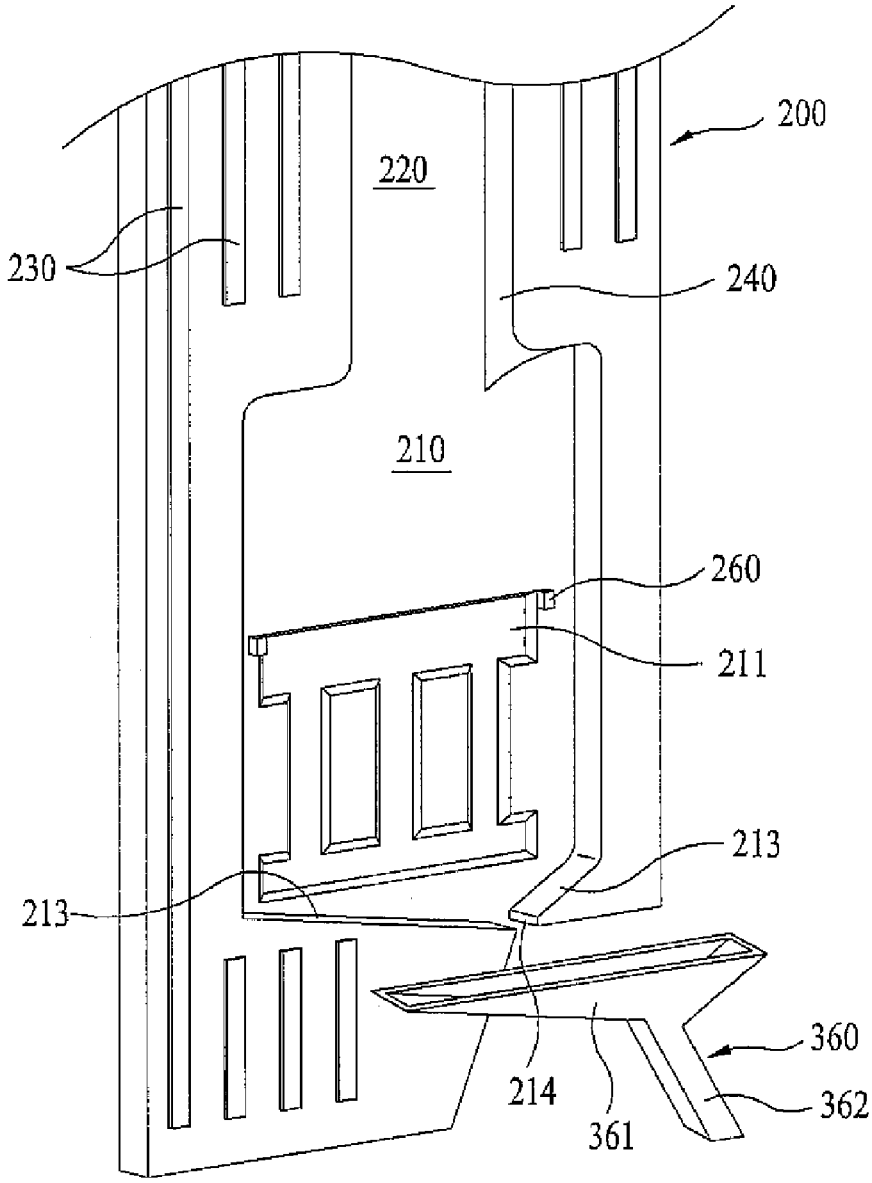
FIG. 8 is a view illustrating the plate of the refrigerator according to the illustrated embodiment of the present invention, and a drainage structure provided at the plate.

As shown in FIG. 8, the mounting section 210 has, at a lower end thereof, a wall surface downwardly inclined by a certain angle. That is, the mounting section 210 has an inclined portion 213 having a certain downward inclination.

The inclined portion 213 has a substantially "V" shape. A drainage hole 214 is formed at a lower end of the inclined portion 213.

In accordance with the above-described structure, condensed water can be outwardly drained through the drainage hole 214 after being guided along the inclined portion 213. In order to more effectively achieve the drainage of the condensed water, a drainage guiding member 360 may be mounted to the lower end of the mounting section 210, namely, the inclined portion 213 and drainage hole 214, as shown in FIG. 8.

The drainage guide member 360 includes a guide 361 and a drainage tube 362. The guide 361 is downwardly inclined by a certain angle such that it faces the inclined portion 213, to guide the condensed water, guided by the inclined portion 213, to flow toward the drainage tube 362. The drainage tube 362 communicates with the drainage hole 214.

The guide 361 has a substantially inverted-triangular shape. The drainage tube 362 is formed at a lower end of the guide 361. The drainage tube 362 communicates with the interior of the guide 361, to outwardly guide the condensed water guided by the guide 361.

Although not shown, the drainage tube 362 may be connected to a drainage hose, to outwardly drain condensed water in a direct manner. Alternatively, the drainage tube 362 may be joined to a drainage tube for condensed water generated in the cold air generator to cool the first cooling compartment. In this case, the condensed water flowing through the drainage tube 362 can be drained together with the condensed water flowing through the drainage tube for the first cooling compartment.

Also, it is possible to collect condensed water, using a waterspout provided in the refrigerator.

As apparent from the above description, the refrigerator according to the present invention provides the following effects.

First, it is possible to greatly increase the capacity of cooling compartments by achieving the supply of cold air to at least one of the cooling compartments through one wall of the plate, and using the space arranged at the rear side of the cooling compartment, as a cooling space.

Second, it is possible to further increase the capacity of the cooling compartments by reducing the capacity of the cold air supplier arranged at one wall of the plate.

Third, it is possible to effectively achieve the filling of the insulator by allowing a foaming liquid for the insulator to flow smoothly through the plate, in spite of the complex shape of the cavity defined in the plate.

Fourth, it is possible to increase the rigidity of the plate by providing the embossings at the plate.

Fifth, it is possible to prevent the inner case constituting the plate from being damaged by preventing the cooler arranged at one wall of the plate from coming into direct contact with the inner case. It is also possible to simply mount the cooler without damaging the plate. Accordingly, it is possible to avoid a degradation in the thermal insulating performance of the plate.

Sixth, it is possible to easily and effectively achieve a defrosting operation for the cooler while preventing the inner case of the plate from being damaged due to heat used for the defrosting operation. It is also possible to effectively drain condensed water generated during the defrosting operation.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator, comprising:

a body defined with a plurality of cooling compartments;

a plate arranged vertically to partition the cooling compartments right and left; and a cold air supplier arranged at one wall of the plate and configured to supply a cold air to at least one of the cooling compartments, wherein the cold air supplier comprises:

a cooler configured to generate a cold air;

a fan unit configured to blow the cold air generated by the cooler; and a cavity provided at one wall of the plate and arranged to provide a seat for mounting the cooler and a passage for guiding the cold air generated by the cooler, and wherein the cavity comprises:

a mounting section in the form of a recess and arranged to provide the seat for the cooler; and a passage section communicating with the mounting section and defining a flow path for the cold air generated by the cooler.

2. The refrigerator according to claim 1, further comprising:

a cold air generator arranged at a rear side of the other of the at least one of the cooling compartments.

3. The refrigerator according to claim 1, wherein at least one of wall and corner portions of the mounting and passage sections is rounded.

4. The refrigerator according to claim 1, wherein the plate includes an embossing protruding from one wall or each wall of the plate and arranged to increase a rigidity of the plate.

5. The refrigerator according to claim 1, wherein the cavity further comprises:

a recess formed to a predetermined depth at a bottom of the mounting section, to prevent the cooler seated on the mounting section from coming into contact with a portion of the bottom of the mounting section or with an overall portion of the bottom of the mounting section.

6. The refrigerator according to claim 1, wherein:

the cavity further comprises protrusions formed to a predetermined height at a bottom of the mounting section; and the cooler includes hangers engaged with the protrusions, respectively, to support the cooler.

7. The refrigerator according to claim 1, further comprising:

a panel arranged to cover the cavity, the panel including an outlet for allowing the cold air flowing through the passage section to be discharged to the cooling compartment associated with the cold air supplier, and an inlet for allowing the cold air to be sucked into the cavity after circulating the associated cooling compartment.

8. The refrigerator according to claim 7, wherein the panel further includes:

a receiving section arranged to receive the fan unit.

9. The refrigerator according to claim 1, wherein the cooler comprises:

a cold air generator configured to generate cold air; and a heater configured to defrost the cold air generator.

10. The refrigerator according to claim 9, wherein the heater comprises:

a cord heater including a cord partially or completely covering the cold air generator of the cooler.

11. The refrigerator according to claim 9, wherein the heater comprises:

a plate heater including a plate partially or completely covering the cold air generator of the cooler.

12. The refrigerator according to claim 1, wherein the cavity further comprises:

a drainage section arranged at a lower end of the mounting section and configured to guide condensed water generated at the cooler during a defrosting operation such that the condensed water is drained.

13. The refrigerator according to claim 12, wherein the drainage section includes:

an inclined portion having a predetermined downward inclination arranged to allow condensed water generated at the cooler during a defrosting operation to flow easily; and a drainage hole arranged at a lower end of the inclined portion and configured to drain the condensed water flowing along the inclined portion.

14. The refrigerator according to claim 13, further comprising:

a drainage guiding member arranged at the drainage section and configured to guide the drainage of the condensed water generated at the cooler.

15. The refrigerator according to claim 14, wherein the drainage guiding member includes:

a guide having an upper end opened to allow the condensed water from the cooler to be introduced into the guide, and a lower end inclined by a predetermined angle such that the guide faces the inclined portion; and a drainage tube formed at the lower end of the guide, to communicate with the drainage hole.

16. A refrigerator, comprising:

a body defined with a plurality of cooling compartments;

a plate arranged to partition the cooling compartments; and a cold air supplier arranged at one wall of the plate and configured to supply a cold air to at least one of the cooling compartments, wherein the cold air supplier comprises:

a cooler configured to generate a cold air;

a fan unit configured to blow the cold air generated by the cooler; and a cavity provided at one wall of the plate and arranged to provide a seat for mounting the cooler and a passage for guiding the cold air generated by the cooler, wherein the cavity comprises:

a mounting section in the form of a recess and arranged to provide the seat for the cooler; and a passage section communicating with the mounting section and defining a flow path for the cold air generated by the cooler, wherein the cavity further comprises protrusions formed to a predetermined height at a bottom of the mounting section, and wherein the cooler includes hangers engaged with the protrusions, respectively, to support the cooler.

* * * * *